US011473815B2

(12) United States Patent
Le Bordays et al.

(10) Patent No.: US 11,473,815 B2
(45) Date of Patent: Oct. 18, 2022

(54) STIRLING-CYCLE COOLING DEVICE WITH MONOBLOC SUPPORT

(71) Applicant: THALES, Courbevoie (FR)

(72) Inventors: Julien Le Bordays, Blagnac (FR); Jean-Yves Martin, Blagnac (FR); Mikel Sacau, Blagnac (FR)

(73) Assignee: THALES, Courbevoie (FR)

( * ) Notice: Subject to any disclaimer, the term of this patent is extended or adjusted under 35 U.S.C. 154(b) by 296 days.

(21) Appl. No.: 16/728,770

(22) Filed: Dec. 27, 2019

(65) Prior Publication Data

US 2020/0208884 A1 Jul. 2, 2020

(30) Foreign Application Priority Data

Dec. 28, 2018 (FR) ..... FR1874268

(51) Int. Cl.

| | |
|---|---|
| ***F25B 9/14*** | (2006.01) |
| ***F02G 1/044*** | (2006.01) |
| *F02G 1/055* | (2006.01) |
| *F02G 1/057* | (2006.01) |

(52) U.S. Cl.

CPC ..... *F25B 9/14* (2013.01); *F02G 1/044* (2013.01); *F02G 1/055* (2013.01); *F02G 1/057* (2013.01); *F02G 2244/50* (2013.01); *F02G 2270/10* (2013.01); *F02G 2270/55* (2013.01); *F02G 2270/85* (2013.01); *F25B 2309/003* (2013.01)

(58) Field of Classification Search

CPC ..... F25B 9/14; F25B 2309/1428

USPC ..... 62/6, 238.2

See application file for complete search history.

(56) References Cited

U.S. PATENT DOCUMENTS

| | | | | |
|---|---|---|---|---|
| 4,365,982 | A | 12/1982 | Durenec | |
| 4,911,618 | A * | 3/1990 | Suganami | F04B 39/0005 417/439 |
| 5,056,317 | A * | 10/1991 | Stetson | F25B 9/14 62/6 |
| 2007/0017247 | A1* | 1/2007 | Pendray | F25B 9/00 417/103 |
| 2010/0244444 | A1* | 9/2010 | Appel | H02K 7/1815 290/2 |
| 2010/0313559 | A1* | 12/2010 | Samarin | F02G 1/044 60/520 |

FOREIGN PATENT DOCUMENTS

| | | | |
|---|---|---|---|
| EP | 0 778 452 | A1 | 6/1997 |
| JP | 8-313093 | A | 11/1996 |
| JP | 9-170491 | A | 6/1997 |

* cited by examiner

*Primary Examiner* — Mickey H France

(74) *Attorney, Agent, or Firm* — BakerHostetler

(57) ABSTRACT

A cooling device employing a thermodynamic cycle of the reverse stirling cycle type is provided. The device includes a compressor with a reciprocating piston driven by a rotary motor about an axis by means of a crankshaft. The device further comprises a monobloc support forming a cylinder in which the piston of the compressor moves. The crankshaft is supported by a single bearing. The bearing is positioned without an intermediate component in a housing of the monobloc support.

9 Claims, 4 Drawing Sheets

STIRLING-CYCLE COOLING DEVICE WITH MONOBLOC SUPPORT

CROSS-REFERENCE TO RELATED APPLICATIONS

This application claims priority to foreign French patent application No. FR 1874268, filed on Dec. 28, 2018, the disclosure of which is incorporated by reference in its entirety.

FIELD OF THE INVENTION

The invention relates to a cooling device employing a thermodynamic cycle of the reverse Stirling cycle type. Such a device is described for example in U.S. Pat. No. 4,365,982. Cooling is achieved by means of a refrigerant circulating in a circuit chiefly comprising a compressor and a regenerator used as a heat exchanger.

The invention is of particular utility in the field of sensors and electronic components that require cooling to a low temperature. The temperature obtained by such a cooling device generally falls within a range of temperatures comprised between 40 and 250 K.

BACKGROUND

The compressor comprises a compression piston capable of translational movement in a cylinder. The regenerator comprises a regeneration piston likewise capable of moving in a second cylinder. The two pistons are each driven by a connecting rod/crank system made up of a crankshaft (which may have one or more crank pins) and of one or more connecting rods. The crankshaft is rotationally driven by a rotary motor. The axes of movement of the two pistons are respectively defined in two planes that are generally parallel and may be distinct or coincident. These planes are generally perpendicular to the axis of rotation of the crankshaft.

In the conventional way, the regeneration piston is driven by the crankshaft, by means of a connecting rod articulated at one end to the crank pin and at the other end to the regeneration piston.

In the known way, the reverse Stirling cycle comprises the following four phases:

- isothermal compression of a fluid at a hot temperature, which is achieved by moving a compression piston in a compression cylinder;
- isochoric cooling of the fluid, from the hot temperature to a cold temperature, this being obtained by the passage of the fluid through a regeneration piston, said piston being in motion in a regeneration cylinder and acting as a heat exchanger;
- an isothermal expansion of the fluid at the cold temperature, this being obtained by the return of the compression piston in the compression cylinder; and
- an isochoric heating of the fluid, from the cold temperature to the hot temperature, this being obtained by the return of the regeneration piston in the regeneration cylinder.

The mechanism with three axes of motion, two axes of translation for the pistons and one axis of rotation for the crankshaft, is generally hyperstatic. Hyperstatism is the result of compromises that are necessary in order to succeed in reconciling the constraints inherent to the manufacture and positioning of the various components of the kinematic linkage of the mechanism with the constraints of acoustic and vibratory discretization dictated by the target applications (notably optronics).

In addition, certain kinematic linkages generally require the use of a lubricant, notably between the pistons and their cylinder or in the connecting rod/crank system. However, these lubricants may contaminate the refrigerant. In a cooling device, such contamination can lead to seizures if one of the contaminants reaches the temperature at which it solidifies. Indeed, in the cryogenic applications envisaged, the cooling requirements often entail reaching cold temperatures well below the temperatures at which the lubricants and contaminants change state.

At the connection between a piston and its cylinder it is possible to dispense with the need for lubricants by reducing the functional radial clearance between the piston and the cylinder. This reduction in the clearance limits the possibilities for self-alignment of the linkages. If there is a desire to limit the degree of hyperstatism at the connections between the crankshaft and the connecting rods it is necessary to provide functional clearances at the crank pin or crank pins. However, because of the alternating forces applied to the pistons, such clearances are taken up twice per revolution and generate knocks. These knocks give rise to undesirable acoustic noises and vibrations at the cooler and at the systems in which the coolers are installed.

The search for isostatism would therefore appear to be contradictory to the search to limit vibrations. There are two envisaged types of solution for improving compliance with these two sets of requirements, these being firstly to produce mechanical components with very tight tolerances and secondly to employ connections comprising inbuilt systems for taking up clearances. These two solutions are not perfect and lead to an increase in production costs, in the mass of the mechanism and in the friction losses for the clearance take-up connections.

Furthermore, in the current solutions, in order to create a mechanism with three axes of movement as described above, it is necessary to assemble a great many mechanical components. These numerous assemblies make the strings of dimensions more complicated and make it necessary to specify, for each component involved in the string of dimensions, ever tighter manufacturing tolerances. In order to limit excessively tight tolerances, it is possible to match the various components with one another or to assemble on jigs. But that makes assembly procedures more complicated.

The invention seeks to alleviate all or some of the abovementioned problems by proposing a device that tends towards a silent and low-vibration isostatic mechanism.

SUMMARY OF THE INVENTION

To that end, the subject of the invention is a Stirling cycle cooling device comprising a compressor with a reciprocating piston driven by a rotary motor about an axis by means of a crankshaft. The device further comprises a monobloc support forming a cylinder wherein the piston of the compressor moves. The crankshaft is supported by a single bearing which is positioned without an intermediate component in a housing of the monobloc support.

Advantageously, the rotary motor comprises a stator fixed directly to the monobloc support.

The device advantageously further comprises a regenerator with a reciprocating piston driven by the rotary motor by means of the crankshaft. The monobloc support then forms a cylinder in which the piston of the regenerator moves.

The piston of the compressor and/or the piston of the regenerator advantageously slide in the monobloc support without an intermediate mechanical component and notably without there being a liner present between the support and the corresponding piston.

The bearing is advantageously positioned between a crank pin of the crankshaft and the rotary motor and supports a rotor of the rotary motor.

The bearing may comprise at least one outer race advantageously produced directly in the monobloc support.

The bearing may comprise two rolling bearing assemblies. The outer races of the rolling bearing assemblies are advantageously produced in the monobloc support.

Advantageously, the rotary motor comprises an internal stator and an external rotor.

The internal stator advantageously has a cylindrical shape open axially along the axis. The monobloc support comprises a tubular bearing surface extending along the axis. The stator is fixed to the outside of the tubular bearing surface. The inside of the tubular bearing surface forms the housing.

BRIEF DESCRIPTION OF THE DRAWINGS

The invention will be better understood and further advantages will become apparent from reading the detailed description of one embodiment which is given by way of example, which description is illustrated by the attached drawing in which.

For the sake of clarity, in the various figures the same elements will bear the same references.

DETAILED DESCRIPTION

Figure 1:
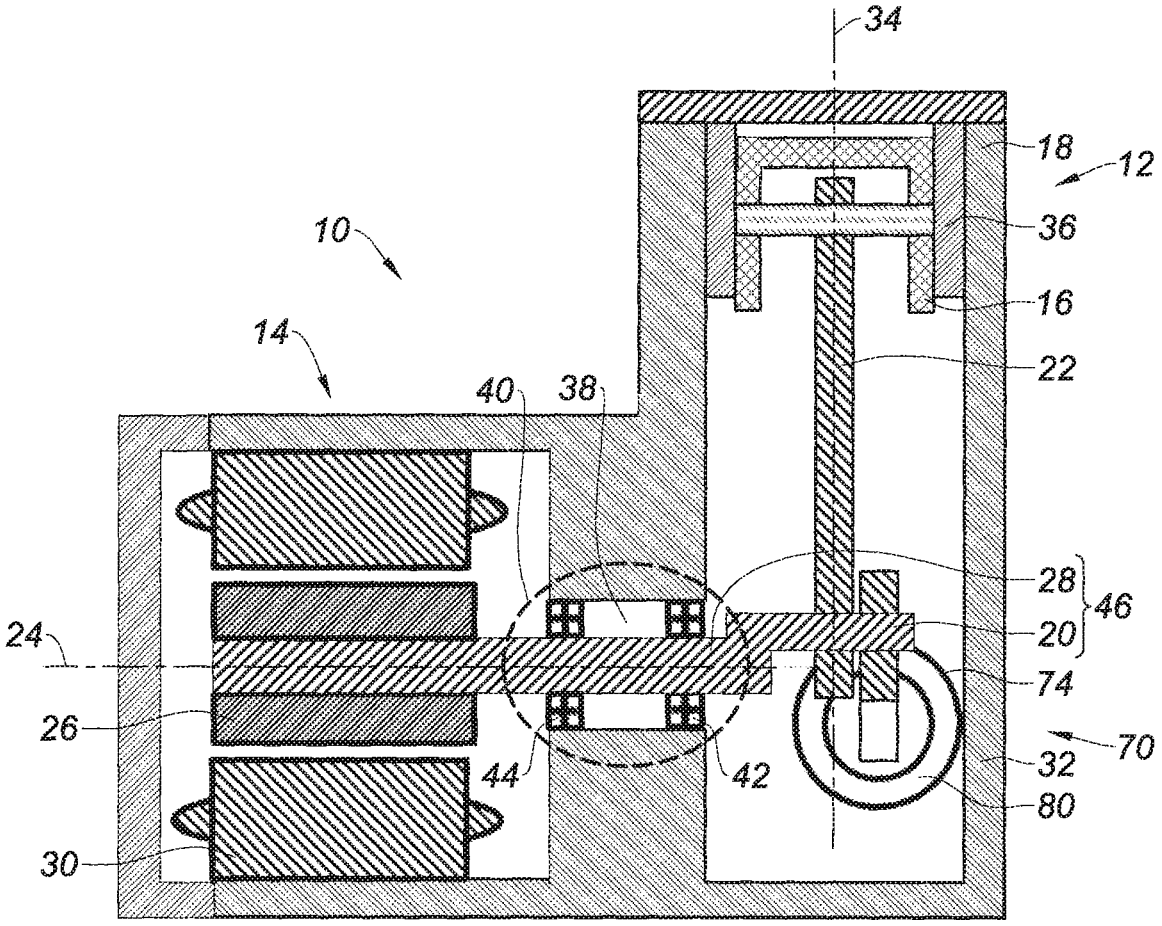
FIG. 1 depicts a view in section of a first alternative form of a first embodiment of a cooling device according to the invention.

FIG. 1 depicts a view in section of a cooling device 10 employing a thermodynamic cycle of the reverse Stirling cycle type. The device comprises a compressor 12 driven by a rotary motor 14. The compressor 12 chiefly comprises a reciprocating piston 16 moving translationally back and forth in a cylinder 18. The piston 16 is driven by a crank pin 20 via a connecting rod 22. The crank pin 20 is driven in rotation by the motor 14 about an axis 24. The motor 14 comprises a rotor 26 driving a driveshaft 28 firmly secured to the crank pin 20. The assembly formed by the driveshaft 28 and the crank pin 20 is referred to here as a crankshaft 46. The rotor 26 is positioned inside a stator 30.

According to the invention, the cooling device 10 comprises a monobloc support 32. In other words, the support 32 is produced as a single mechanical component. The support 32 comprises a bore extending along an axis 34 perpendicular to the axis 24. The bore forms the cylinder 18 in which the piston 16 moves. A liner 36 borne by the support 32 is interposed between the support 32 and the piston 16.

The support 32 further comprises a housing 38 in which a bearing 40 supporting the crankshaft 46 is situated. The bearing 40 is positioned in the housing 38 without an intermediate component between the bearing 40 and the housing 38. The monobloc support 32 is advantageously produced without assembly. In the method for manufacturing the support 32, an assembly operation may be accepted provided that the bore that forms the cylinder 18 and the housing 38 that receives the bearing 40 are machined after assembly. This machining operation performed after assembly makes it possible to avoid assembly tolerances combining with the tolerance on the assembly connecting the cylinder 18 and the housing 38. In other words, what is meant by monobloc is a mechanical component the manufacturing tolerances of which are not affected by any assembly operation that may take place during its method of manufacture. In the same way, positioning the bearing 40 in the support 32 without an intermediate component makes it possible to limit the strings of dimensions between the cylinder 18 and the crankshaft 46. No intermediate mechanical component the dimensions of which would lengthen the string of dimensions is situated between the housing 38 and the bearing 40.

The axis 24 is defined as being the axis of rotation of the bearing 40. A single bearing 40 bears the rotary part of the cooling device 10, which rotary part is formed by the rotor 26 and the crankshaft 46. This single bearing 40 allows for easier production of the support 32. Specifically, it would be possible to support the rotary part by means of two bearings, situated for example one at each end of the crankshaft. However, such an arrangement imposes tight manufacturing tolerances in order to align the two bearings along the axis 24. Having just one bearing makes it possible to avoid this alignment constraint.

The housing 38 overall adopts the form of a bore extending along the axis 24. In order to limit the unsupported overhang of the driveshaft, the housing 38 is situated between the motor 14 and the crank pin 20. Alternatively, it is equally possible to arrange the housing 38, and therefore the bearing 40, on the other side of the motor 14 or on the other side of the crank pin 20. However, positioning the bearing 40 between the motor 14 and the crank pin 20 allows the best distribution of the loads borne by the bearing 40, which are exerted notably by the compressor 12 and by the motor 14.

The bearing 40 is formed for example of two rolling bearing assemblies 42 and 44 of which the outer races are firmly secured to the housing 38 and of which the inner races bear the driveshaft 28. The rolling bearings 42 and 44 may be twinned in the form, for example, of a double-row rolling bearing with a shared outer race and two distinct inner races so as to limit as far as possible the clearances in the bearing 40. Alternatively, it is possible to replace the rolling bearing assemblies with a plain bearing. The outer races of the rolling bearing assemblies 42 and 44 or the outer ring of the plain bearing may be fixed to the support 32 by means of a tight fit and/or of adhesive applied between the outer race or races and the support 32. This adhesive does not constitute an intermediate mechanical component between the support 32 and the bearing 40. In order to limit the string of dimensions between the cylinder 18 and the crankshaft 46, the outer race of the plain bearing may be directly produced in the monobloc support 32.

Producing the cylinder of the compressor 12 and the housing 38 for the single bearing 40 from the one same mechanical component, in this instance the support 32, limits the complex strings of dimensions or procedures of assembly using positioning tools which would otherwise exist if the housing and the cylinder were produced in two distinct mechanical components.

It is also possible to fix the stator 30 of the motor 14 directly on the support 32. That makes it possible to simplify the string of dimensions that define the functional clearance between the stator 30 and the rotor 26. This string of dimensions involves only the stator 30, the support 32, the bearing 40, the driveshaft 28 and the rotor 26. No other mechanical component belonging to the class of equivalence of the support 32 appears in this string of dimensions.

Figure 2:
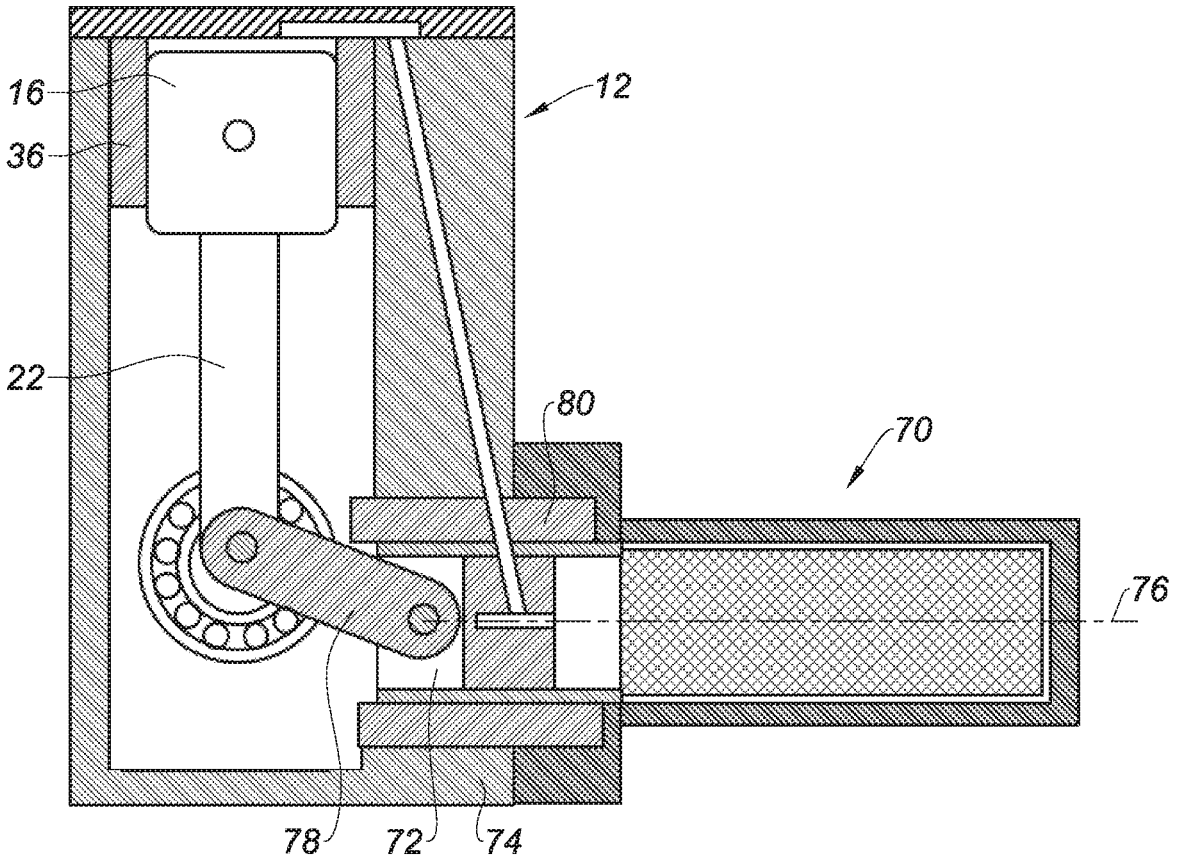
FIG. 2 depicts another view of the first alternative form.

FIG. 2 depicts the cooling device 10 in section on a plane perpendicular to the plane of section of FIG. 1, namely perpendicular to the axis 24. The cooling device 10 further comprises a regenerator 70 likewise driven in rotation by the motor 14 and, more specifically, by the crankshaft 46. In the literature, the regenerator is sometimes referred to as a displacer. The regenerator 70 chiefly comprises a reciprocating piston 72 moving in translation in a back and forth motion inside a cylinder 74 along an axis 76. In the example depicted, the axis 76 of the regenerator 70 is perpendicular to the axis 34 along which the piston 16 of the compressor 12 moves. It is also possible to produce a cooling device according to the invention with other relative orientations of the axes 76 and 34. The piston 72 is driven by the crank pin 20 via a connecting rod 78. Alternatively, the crankshaft 46 may comprise a second crank pin, distinct from the crank pin 20, and driving the connecting rod 78. The cylinder 74 is advantageously produced in the monobloc support 32. In other words, the support 32 comprises a bore forming the cylinder 74. As with the compressor 12, the bore of the regenerator 70 is lined. In other words, a liner 80, borne by the support 32, is interposed between the support 32 and the piston 72.

Figure 3:
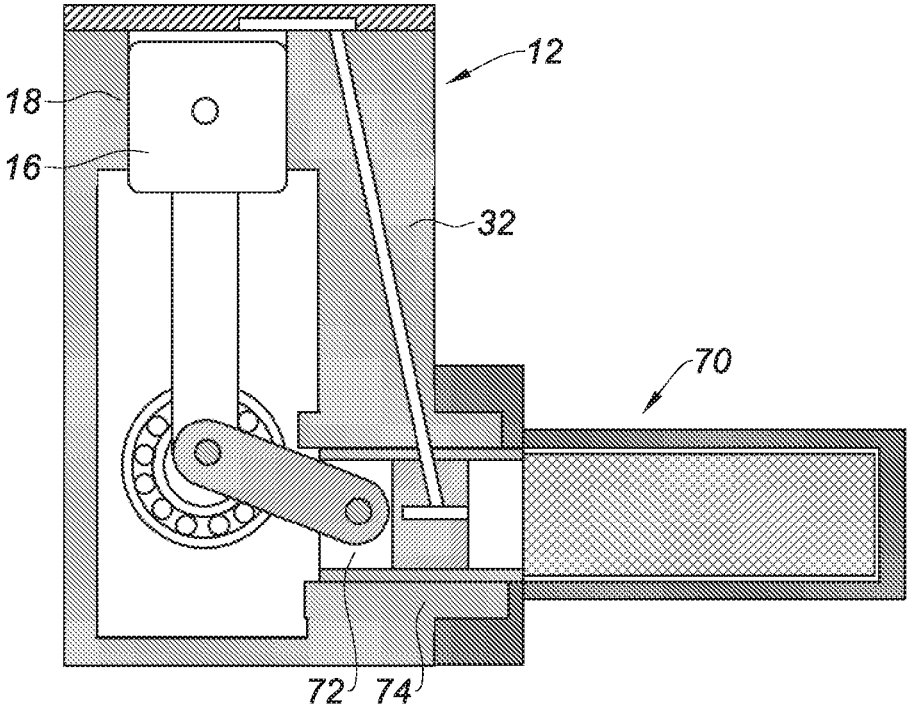
FIG. 3 depicts a view in section of a second alternative form of the first embodiment.

FIG. 3 depicts an alternative form of the cooling device 10 in section on a plane similar to that of FIG. 2. Again we see the compressor 12 and the regenerator 70. In the support 32 is the bore that forms the cylinder 18 of the compressor 12 and the bore that forms the cylinder 74 of the regenerator 70. Unlike in FIGS. 1 and 2, the cylinders 18 and 74 of the support 32 are not lined and the pistons 16 and 72 slide in the support 32 without any intermediate mechanical component. More specifically, the only intermediate between a piston and its cylinder may be a fluid, a fluid or solid lubricant. It is possible to maintain a liner for one of the pistons only, either for the piston 16 or for the piston 72. The invention is already advantageous if at least one of the two liners 36 or 80 is omitted.

Figure 4:
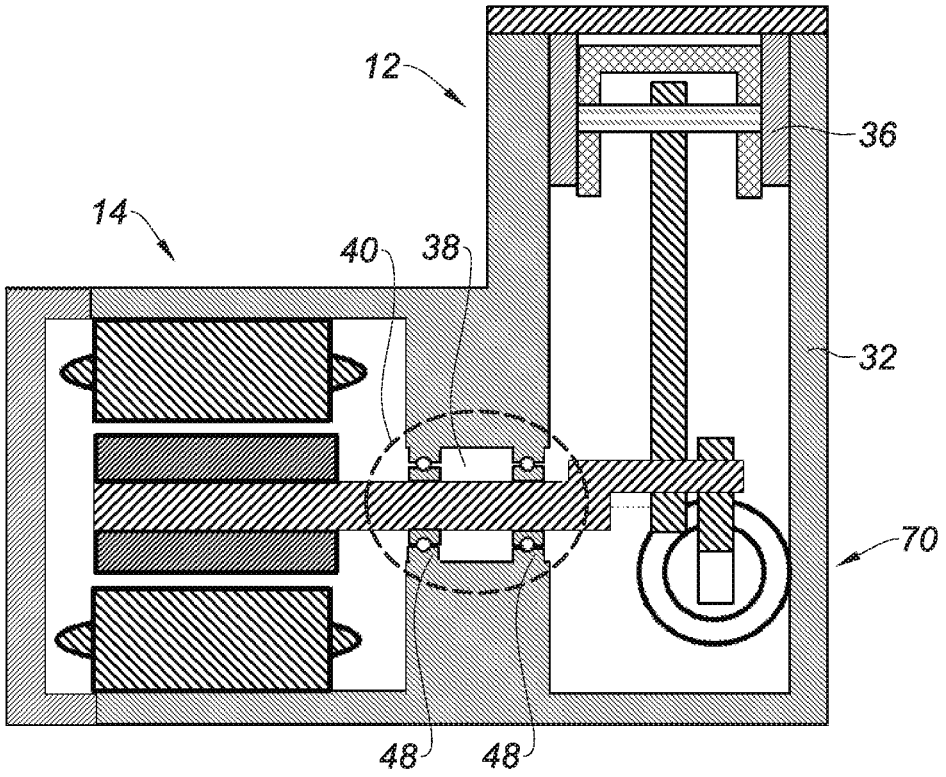
FIG. 4 depicts a view in section of a third alternative form of the first embodiment.

FIG. 4 depicts another alternative form of the cooling device 10 depicted in FIG. 1. We again find the compressor 12, the regenerator 70 and the motor 14. In the support 32 are the bores that form the cylinders 18 and 74 and the housing 38 in which the bearing 40 is positioned. Unlike in FIG. 1, the outer races 48 of the rolling bearing assemblies 42 and 44 are directly produced in the support 32. The housing 38 is more complicated to produce but, in this alternative form, there is no longer any fitting-together of the outer races of the rolling bearing assemblies and the support 32 to be considered.

In FIG. 4 the liner 36 is shown. It is of course possible to dispense with this liner as depicted in FIG. 3. The same is true of the liner 80 which can be dispensed with in the alternative form of FIG. 4.

Figure 5:
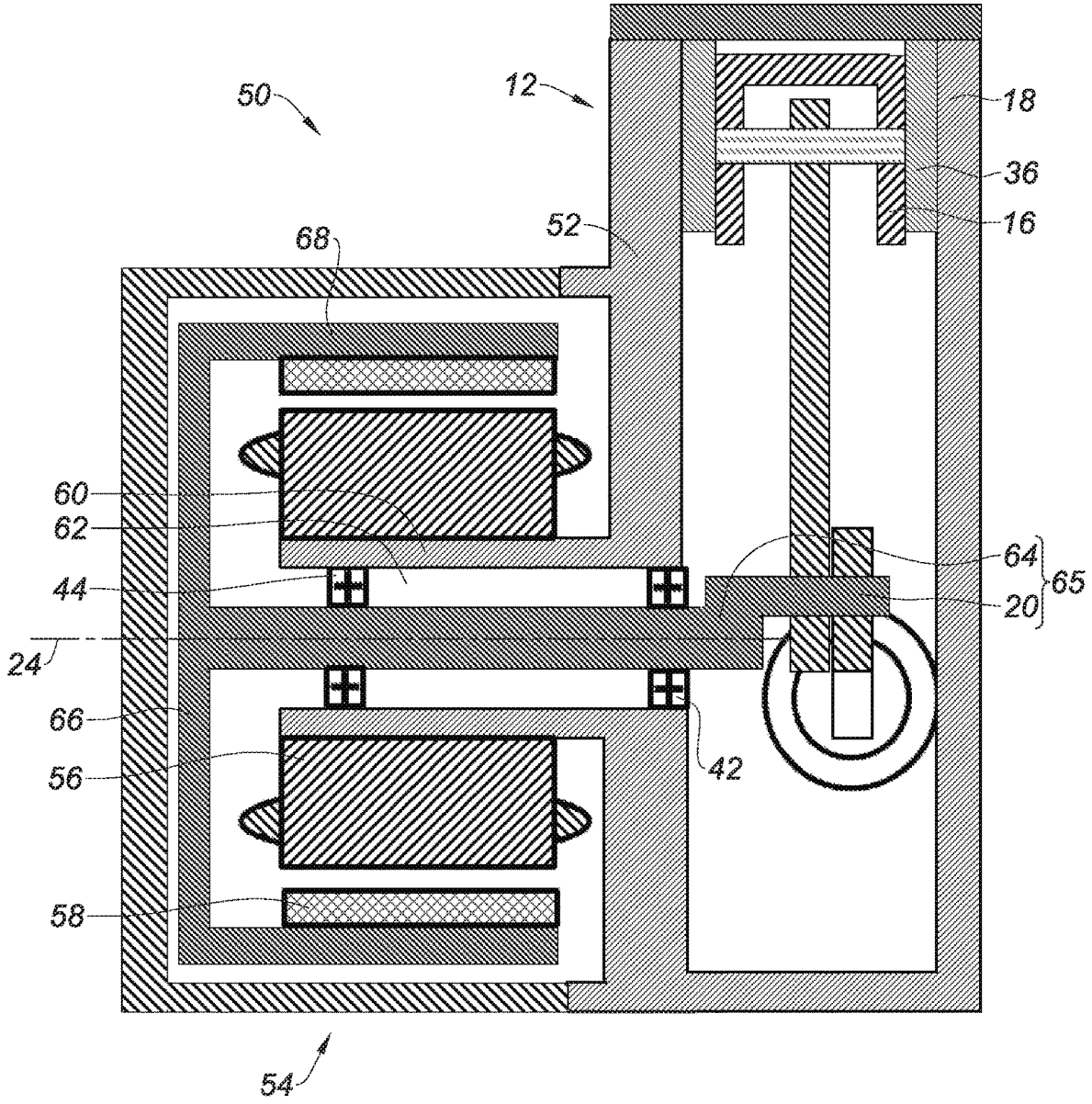
FIG. 5 depicts a second embodiment of a cooling device according to the invention.

FIG. 5 depicts a second cooling device 50 employing a thermo-dynamic cycle of the reverse Stirling cycle type. Here again we find the compressor 12 the piston 16 of which is driven by the crankshaft 20. In FIG. 5, the liner 36 acts as an intermediary between the bore of the support 52 and the piston 16. It is of course possible to dispense with the liner 36, as described with reference to FIGS. 2 to 4.

In the cooling device 50, a crankshaft 65 is driven by an electric motor 54 with an external rotor. In a cooling device operating on a cycle of the reverse Stirling cycle type, the reciprocating movement of the pistons in their respective cylinder generates alternating and potentially phase-shifted axial loadings. These loadings applied by the pistons are transmitted to the crank pin 20 by the linkages present in the cooling device 50. The combination of these loadings results in a resistive torque of variable amplitude on the driveshaft 64. More specifically, this torque exhibits strong variations in amplitude between a value close to zero and a maximum value that is reached twice per revolution. It is possible to limit the impact that these variations in resistive torque have on the drive by using a flywheel added to the driveshaft. However, the addition of this type of moving part leads to an increase in the volume, the mass and the cost of the cooling device 50. A motor with an external rotor has, by construction, a higher moment of inertia about its axis of rotation than a motor with an internal rotor as described in FIGS. 1 to 4. Use of a motor with an external rotor therefore makes it possible to combine the functions assumed by the rotor and the flywheel into the one same component. Furthermore, for a given volume and a given efficiency, a motor with an external rotor is able to generate a torque higher than that of a motor with an internal rotor. Likewise, for a given torque, the use of a motor with an external rotor therefore makes it easier to miniaturize the cooling device.

The stator 56 of the motor 54 has a cylindrical shape open along the axis of rotation 24 of the motor. The stator 56 comprises for example windings able to generate a rotary magnetic field extending radially with respect to the axis 24 at the periphery of the stator 56.

The motor 54 comprises a rotor 58 produced in the form of a tubular segment with axis of revolution 24. The rotor 58 is arranged radially around the stator 56. The rotor 58 may comprise windings or permanent magnets intended to lock on to the magnetic field generated by the stator windings. The use of permanent magnets makes it possible to avoid the use of rotary contacts, such as brushes or carbon brushes required to supply power to the rotor windings.

The support 52 is monobloc like the support 32 and comprises a tubular bearing surface 60 extending along the axis 24. The stator 56 is fixed to the outside of the tubular bearing surface 60 which passes through the stator 56. The inside of this tubular bearing surface 60 forms a housing 62 in which the bearing 40 supporting the driveshaft 64 is situated. As before, only the bearing 40 bears the rotary part of the cooling device 50 which rotary part is formed by the rotor 58 and the crankshaft 65, here formed by the driveshaft 64 and the crank pin or crank pins 20. In FIG. 5, the bearing 40 is formed of the two rolling bearing assemblies 42 and 44. As before, the outer races of the rolling bearing assemblies 42 and 44 may be produced directly in the support 52 and more specifically inside the bearing surface 60. Furthermore, the rolling bearing assemblies 42 and 44 may be replaced by other mechanical components such as plain bearings. Just as in the device 10, the two rolling bearing assemblies 42 and 44 of the device 50 may for example be combined into a single double-row rolling bearing having two rows of rolling elements with a common outer race and two distinct inner races.

The embodiment of FIG. 5 allows the rolling bearing assemblies 42 and 44 to be moved apart along the axis 24, providing better mechanical stability to the rotating parts of the cooling device 50. The rolling bearing assemblies 42 and 44 may be ball bearings or roller bearings. The rolling bearings may be straight-contact or angular-contact rolling bearings.

The driveshaft 64 is securely attached to a web 66 positioned at right angles to the axis 24. The web 66 is securely attached to a segment of tube 68 with axis of revolution 24. The rotor 58 is fixed inside the segment of tube 68. The motor 54 is positioned between the support 52 and web 66.

The invention claimed is:

1. A stirling-cycle cooling device comprising a compressor with a reciprocating piston driven by a rotary motor about an axis by means of a crankshaft, wherein the device further comprises a monobloc support forming a cylinder in which the reciprocating piston of the compressor moves, the monobloc support providing support for the cylinder, the motor, and the crankshaft, and wherein the cooling device comprises a single bearing, the single bearing supports both the crankshaft and a moving part of the motor, and the single bearing arranged without an intermediate component in a housing of the monobloc support.

2. The device according to claim 1, wherein the rotary motor comprises a stator fixed directly to the monobloc support.

3. The device according to claim 1, further comprising a regenerator with a reciprocating piston driven by the rotary motor by means of the crankshaft and in that the monobloc support forms a cylinder in which the piston of the regenerator moves.

4. The device according to claim 1, wherein the piston of the compressor and/or the piston of a regenerator slide in the monobloc support without an intermediate mechanical component.

5. The device according to claim 1, wherein the bearing is positioned between a crank pin of the crankshaft and the rotary motor, wherein the bearing supports a rotor of the rotary motor.

6. The device according to claim 1, wherein the bearing comprises at least one outer race directly produced in the monobloc support.

7. The device according to claim 1, wherein the bearing comprises two rolling- bearing assemblies and in that the at least one outer race of the two rolling bearing assemblies is produced in the monobloc support.

8. The device according to claim 1, wherein the rotary motor comprises an internal stator and an external rotor.

9. The device according to claim 8, wherein the internal stator has a cylindrical shape open axially along the axis, the monobloc support comprises a tubular bearing surface extending along the axis, wherein the stator is fixed to the outside of the tubular bearing surface, and the inside of the tubular bearing surface forms the housing.

* * * * *